United States Patent [19]

Merritt

[11] 4,434,455

[45] Feb. 28, 1984

[54] DIFFERENTIAL LIGHT EMISSION TRANSLUCENT LIGHT BOWL AND CAP

[76] Inventor: William H. Merritt, 3812 - 32nd Ave. West, Seattle, Wash. 98199

[21] Appl. No.: 259,404

[22] Filed: May 1, 1981

[51] Int. Cl.[3] ..... F21V 7/00

[52] U.S. Cl. ..... 362/307; 362/293; 362/310; 362/311; 362/347; 362/355; 362/361; 362/363; 362/375; 362/431

[58] Field of Search ..... 362/363, 311, 2, 152, 362/335, 351, 361, 293, 310, 347, 355, 375, 431

[56] References Cited

U.S. PATENT DOCUMENTS

| | | | |
|---|---|---|---|
| Re. 19,216 | 6/1934 | Pipkin | 362/293 X |
| 627,239 | 6/1899 | Prendergast | 362/363 |
| 1,543,606 | 6/1925 | Harrison | 362/363 X |
| 1,609,277 | 11/1926 | Oliver | 362/363 |
| 1,778,305 | 10/1930 | Blau | 362/363 X |
| 1,833,122 | 11/1931 | Oliver | 362/293 |
| 2,830,171 | 4/1958 | Buck | 362/363 X |
| 4,160,286 | 7/1979 | Merritt | 362/363 X |

*Primary Examiner*—Donald G. Kelly
*Assistant Examiner*—John S. Maples
*Attorney, Agent, or Firm*—Robert W. Beach; Ward Brown

[57] ABSTRACT

The light source of an area light or streetlight mounted on a lamppost is enclosed by a lower upwardly flaring bowl having its upper end closed by a generally conical cap. The cap and bowl are made of polycarbonate pigmented by titanium dioxide so that the cap emits only light sufficient to enable its shape to be seen in darkness and the bowl is much more translucent to emit adequate light for illumination.

1 Claim, 3 Drawing Figures

DIFFERENTIAL LIGHT EMISSION TRANSLUCENT LIGHT BOWL AND CAP

BACKGROUND OF THE INVENTION

1. Field of the Invention

This invention relates to a lighting device of the area light or streetlight type and more particularly to the enclosure for the light source of such a device having differential light transmission characteristics.

2. Prior Art

Area lights or streetlights have customarily included translucent or transparent enclosures for the light source but such enclosures have either had uniform light transmission characteristics or have included a lower light-transmitting portion and an upper opaque portion.

SUMMARY OF THE INVENTION

It is a principal object of the present invention to provide an enclosure for the light source of an area light or streetlight, portions of which have differential light transmission characteristics.

A more specific object is to provide such a light source enclosure having one portion illuminated only sufficiently so that its shape can be seen in the dark and another portion which will emit sufficient light for purposes of area illumination.

The foregoing objects can be accomplished by providing an enclosure enclosing the light source of an area light or streetlight having two principal portions, one of which will emit only approximately sufficient light so that its shape can be seen in the dark and the other portion of which will emit much more light to provide effective area illumination particularly at the ground.

DETAILED DESCRIPTION

Figure 1:
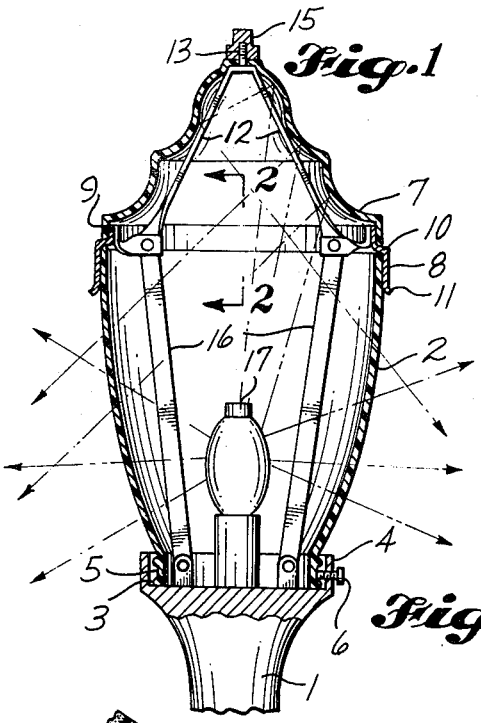
FIG. 1 is a vertical section through the upper portion of an area light or streetlight embodying the present invention.

The particular mechanical construction of the lighting device of the present invention does not constitute part of the present invention except to the extent that such construction contributes to the accomplishment of the results which the invention achieves, namely, providing a lighting device which will produce effective illumination with minimum waste while enabling the shape of the light source enclosure as a whole to be seen in the dark for its decorative character. A representative construction of a lighting device in which the present invention is embodied is illustrated in the drawings.

The lamppost 1 is surmounted by an enclosure for the light source including a lower bowl section 2. Such bowl section flares upwardly and preferably is generally in the shape of a frustum of a hyperboloid of revolution. A lower annular mounting flange 3 is of a size to be received within the upwardly opening socket of the lamppost defined by an upwardly projecting flange 4. The bowl flange 3 has an outwardly opening annular groove 5 into which the inner ends of set screws 6 screwed into tapped holes of the lamppost flange 4 can be fitted to retain the bowl on the lamppost.

The open upper end of the bowl 2 is closed by a cap 7 flared downwardly and preferably of generally conical shape. The axial extent of the cap is less than the axial extent of the bowl. Also, the diameter of the base of the cap is preferably somewhat greater than the axial extent of the cap so that the apex angle of the cap is of the order of 70 degrees to 80 degrees. While the cap can be of strictly conical shape, it can have a more ornamental appearance as shown in FIGS. 1 and 3 by having an annular rib of cusp cross section located generally centrally heightwise interposed between two shallow annular concave grooves.

Figure 2:
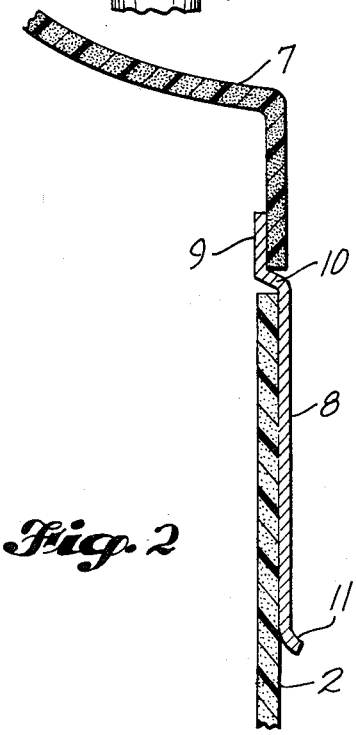
FIG. 2 is a detailed fragmentary section through a portion of the area light or streetlight head taken on line 2—2 of FIG. 1.

A convenient connection between the cap 7 and the bowl 2 can be effected by a coupling ring having an upper inset flange 9 slightly smaller than the skirt of the cap 7. Such flange is integrated with the mounting ring by an offset 10. As shown in FIG. 2 the lower portion of the ring is of a size to fit over the upper margin of the bowl and the offset 10 is of a radial extent approximately equal to the wall thickness of the bowl and the cap so that, as shown in FIG. 2, the cap skirt and the upper margin of the bowl are in substantial alignment. The lower margin 11 of the coupling ring can be flared to facilitate fitting of the coupling ring over the upper margin of the bowl.

It is preferred that the coupling ring 8 simply effect the alignment relationship of the cap 7 to the bowl 2. Instead of the bowl actually supporting the weight of the cap, the cap can be supported from the coupling ring by a wishbone 12 having a stud 13 projecting upward from its upper end formed by the junction of its arms. An aperture 14 in the apex of the cap can fit over such stud. The legs of the wishbone are secured to diametrally opposite portions of the coupling ring flange 9, as shown in FIG. 3. The cap can be secured to the wishbone by a cap nut or box nut 15 screwed onto the stud 13 to hold the cap in place.

Figure 3:
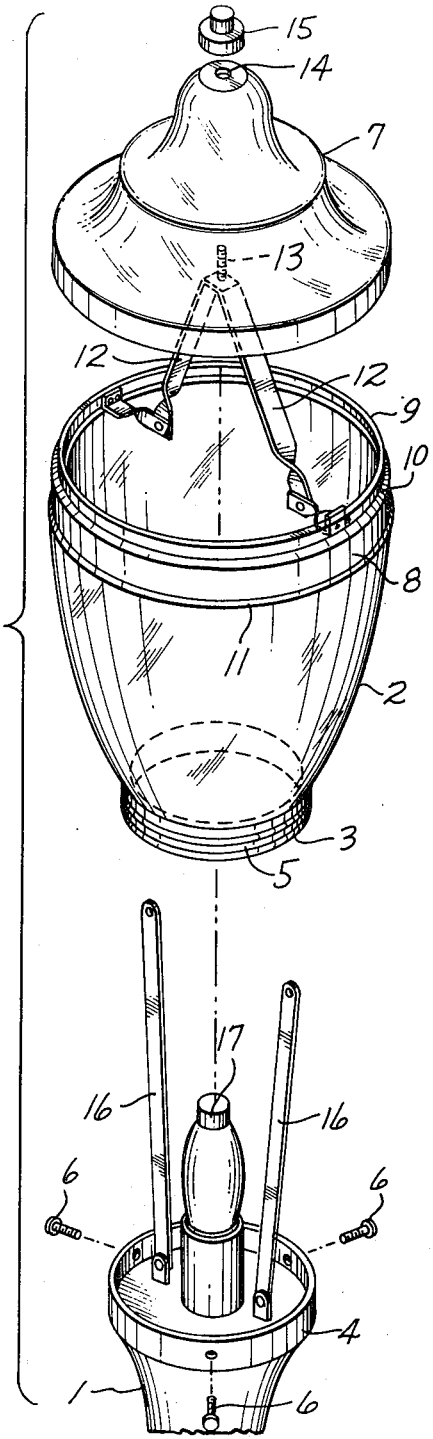
FIG. 3 is a top perspective of the light head showing parts in exploded relationship.

The coupling ring 8, instead of being supported only by the bowl 2, is supported by the lower portions of the arms of wishbone 12 that in turn are supported by struts 16 connected between the ends of the wishbone arms and the upper end of the lamppost 1 as shown in FIGS. 1 and 3. Such struts straddle the light source 17 located within the lower portion of the bowl which may be of the mercury vapor or sodium type.

The present invention is concerned with the nature and characteristics of the bowl 2 and the cap 7 which cooperate to form the enclosure for the light source 17. From an ornamental point of view, it is desirable for the entire shape of the lighting device head to be visible even at night. From the point of view of utility, it is important that the lighting device provide as much illumination as possible, consistent with the light propagated being diffuse rather than direct. Moreover, it is desirable for the light enclosure to be strong and virtually unbreakable so as to withstand shocks of impacts by stones thrown by pranksters.

In order for the shape of the light enclosure to be discernable in the darkness, the cap 7 should be slightly transparent to transmit just enough light to enable the contour of the cap to be discerned readily at a reasonable distance. On the other hand, the bowl 2 should be made of material that is sufficiiently translucent to provide adequate illumination. Consequently, there will be a great differential in light transmission between the cap 7 and the bowl 2.

In order to provide adequate strength and shock resistance, it is preferred that the cap 7 and bowl 2 be made of polycarbonate. The polycarbonate of the cap can be pigmented such as with titanium dioxide to color it white and to limit its light transmission to a value which will enable its contour to be observed reasonably readily in the darkness. The carbonate of the bowl 2 should also be pigmented such as with titanium dioxide but only sufficient pigment should be mixed with the polycarbonate to obscure direct view of the light source 17 as would be possible if the globe were transparent, but the bowl should be sufficiently translucent to provide effective transmission of light for external illumination.

As indicated by the arrows in FIG. 1, light transmitted through the wall of the bowl 2 may be projected directly from the light source 17 or can be reflected from the internal surface of the generally conical cap 7. The light thus reflected will be emitted from the bowl in a downward direction to illuminate the area surrounding the lighting device. About 70 percent of the light striking the bowl will be transmitted through its wall.

The cap 7 and the bowl 2 are made by molding these components of polycarbonate plastic. The bowl is made of a mixture of approximately 5 parts of clear polycarbonate to 1 part of titanium dioxide by volume. Such tinting of the bowl will obscure direct observation of the light source, but the resulting bowl wall will be sufficiently translucent to enable light transmission from the light source 17 to produce adequate area illumination. Substantially more titanium dioxide pigment is mixed with the clear polycarbonate from which the cap is molded. The polycarbonate material of the cap may, for example, have equal parts of clear polycarbonate and of titanium dioxide by volume.

I claim.

1. A lighting device adapted to be mounted on a lamppost, comprising a light source, and an enclosure composed of a lower bowl portion in the shape of an upwardly flaring body of circular cross section enclosing said light source and having an open upper end located a substantial distance above said light source and a generally conical cap separate from said lower bowl portion and having its base closing the upper end of said lower bowl portion, said light source projecting light rays to the inner surface of said generally conical cap without obstruction, said bowl and said cap being made of the same kind of plastic material having the same color characteristics, the plastic material of said lower bowl portion containing pigment so that said lower bowl portion is highly translucent but not transparent and the material of said cap containing a much greater proportion of the same pigment as in the lower bowl portion material so that said cap is slightly translucent, much less translucent than the material of said lower bowl portion, thereby effecting transmission of a much greater portion of the light emanating from said light source through said lower bowl portion than through said cap and effecting reflection downward from the interior of said generally conical cap of light projected upward from said light source to pass through the wall of said lower bowl portion, for producing a strong downward illumination and a faint upward illumination.

* * * * *